US007870978B2

(12) United States Patent
Pardonge et al.

(10) Patent No.: US 7,870,978 B2
(45) Date of Patent: Jan. 18, 2011

(54) PUMP FOR DISPENSING FLUID PRODUCTS

(75) Inventors: Jean-Marc Pardonge, Les Authieux sur Port Saint Ouen (FR); Christophe Fagot, Mezy sur Seine (FR); Samuel Pruvot, Saint Etienne du Vauvray (FR); Francois Le Maner, La Vallée Montaure (FR)

(73) Assignee: Valois SAS, Le Neubourg (FR)

( * ) Notice: Subject to any disclaimer, the term of this patent is extended or adjusted under 35 U.S.C. 154(b) by 703 days.

(21) Appl. No.: 10/578,406

(22) PCT Filed: Nov. 3, 2004

(86) PCT No.: PCT/FR2004/050559

§ 371 (c)(1),
(2), (4) Date: Mar. 21, 2007

(87) PCT Pub. No.: WO2005/044463

PCT Pub. Date: May 19, 2005

(65) Prior Publication Data

US 2007/0272712 A1 Nov. 29, 2007

(30) Foreign Application Priority Data

Nov. 7, 2003 (FR) ..... 03 13093

(51) Int. Cl.
*G01F 11/00* (2006.01)

(52) U.S. Cl. ..... 222/321.7; 222/321.6; 222/340

(58) Field of Classification Search ..... 222/321.1, 222/321.6, 321.7, 321.8, 321.2, 321.9, 340, 222/341, 372; 239/333
See application file for complete search history.

(56) References Cited

U.S. PATENT DOCUMENTS

| | | | | |
|---|---|---|---|---|
| 4,503,997 | A * | 3/1985 | Corsette | 222/321.9 |
| 4,640,443 | A * | 2/1987 | Corsette | 222/321.6 |
| 4,830,284 | A | 5/1989 | Maerte | |
| 5,207,659 | A | 5/1993 | Pennaneac'h et al. | |
| 5,377,881 | A | 1/1995 | Jouillat | |
| 5,816,453 | A | 10/1998 | Spencer et al. | |
| 6,209,760 | B1 * | 4/2001 | Fuchs | 222/321.6 |
| 7,014,069 | B2 * | 3/2006 | Crosnier et al. | 222/321.7 |
| 7,182,226 | B2 * | 2/2007 | Mbonyumuhire | 222/321.7 |
| 2003/0183655 | A1 | 10/2003 | Padar | |

FOREIGN PATENT DOCUMENTS

| | | | |
|---|---|---|---|
| FR | 2838787 | A1 | 10/2003 |

* cited by examiner

*Primary Examiner*—Kevin P Shaver
*Assistant Examiner*—Jonathan Wood
(74) *Attorney, Agent, or Firm*—Sughrue Mion, PLLC

(57) ABSTRACT

The pump for dispensing fluid products includes a pump body (10), a pump chamber (20) at least one piston (72) sliding inside the pump chamber (20) for dispensing a fluid product, a dispensing orifice (45) and a shutter (38) which interacts with the dispensing orifice (45) and is embodied in such a way that it is movable and/or deformable between the closed position of the dispensing orifice (45) and the open position thereof, the shutter being elastically driven to a closed position. The pump includes only one elastic element (50) in the form of a spring for bringing at least one piston (72) to a rest position after actuation and for driving the shutter (38) to a closed position and the pump body (10) is embodied in one piece with the shutter (38).

17 Claims, 3 Drawing Sheets

PUMP FOR DISPENSING FLUID PRODUCTS

BACKGROUND OF THE INVENTION

1. Field of the Invention

The present invention relates to a pump for dispensing fluid products, and a device for dispensing fluid products comprising such a pump.

2. Description of Related Art

Pumps for dispensing fluid products are well known in the prior art, and are used to dispense fluid products, particularly in the areas of perfumery, cosmetics or pharmacy. These pumps generally comprise a pump body and a pump chamber in which at least one piston slides in order to dispense a dose of product each time it is actuated. The pump chamber generally comprises an inlet valve and an outlet valve. A dispensing head incorporating the dispensing orifice is generally assembled on the pump, said head comprising an expulsion channel connecting said pump to said dispensing orifice. In particular when the fluid product is a pharmaceutical product, it may be necessary to avoid any contamination of this product, in which case a shutter or obturator can be provided in the dispensing orifice. This shutter is generally driven to its closed position by an elastic element, and is opened at the time of expulsion in order to allow the product to come out. When the device is a spray device, an insert may additionally be provided placed in the expulsion channel to reduce the ullage or dead volume thereof and to promote the spraying of the product. Since the pump is part of a device for dispensing fluid product, a retaining or fixing ring is generally provided to anchor this pump to a tank containing the fluid product. A plunger or dip tube may also be combined with the pump in order to extend to the bottom of the tank and allow the totality of the product contained therein to be dispensed. This type of pump, which is well-known, comprises a relatively high number of constituent parts, which makes its manufacture and assembly relatively complicated and expensive. Another problem which may arise, particularly when the fluid product is a pharmaceutical product, is that the product is generally in contact with the pump springs, these generally being made of metal. Depending on the pharmaceutical product under consideration, this type of contact with a metal product may be damaging and cause the product to be corrupted.

BRIEF SUMMARY OF CERTAIN EMBODIMENTS OF THE INVENTION

The purpose of the present invention is to provide a pump for dispensing fluid product which does not reproduce the above-mentioned drawbacks.

More particularly, the purpose of the present invention is to provide a pump for dispensing fluid products which is simple and inexpensive to manufacture and assemble.

A particular purpose of the present invention is to provide a pump for dispensing fluid products which is composed of a minimum number of constituent parts.

Another purpose of the present invention is to provide a pump for dispensing fluid products, which eliminates any risk of the fluid product dispensed by said pump being corrupted, particularly by eliminating all contact with metal parts.

The subject matter of the present invention is therefore a pump for dispensing fluid products comprising a pump body, a pump chamber, at least one piston sliding in said pump chamber to dispense the fluid product, a dispensing orifice, and a shutter interacting with said dispensing orifice, said shutter being movable and/or deformable between a closed position of the dispensing orifice and an open position of the dispensing orifice, said shutter being elastically driven to its closed position, the pump comprising only one elastic element, such as a spring, adapted for bringing said at least one piston back to its rest position after actuation and for driving said shutter to its closed position, and said pump body being embodied in one piece with said shutter.

To advantage, said spring is away from any contact with the fluid product.

To advantage, the pump comprises a retaining ring adapted to anchor said pump to a tank.

To advantage, said retaining ring is embodied in one piece with a plunger tube intended to extend into a tank.

To advantage, said retaining ring is embodied in one piece with an inlet valve seat of the pump chamber.

Preferably, the pump comprises a dispensing head including the dispensing orifice.

According to one embodiment variant of the invention, said pump body is placed inside said dispensing head.

To advantage, said dispensing head is connected, particularly by being snapped, irremovably onto said retaining ring, said dispensing head and said retaining ring forming a stop to define the rest position of the pump.

To advantage, said piston is embodied in one piece with said retaining ring.

To advantage, said pump is constituted by only four parts including part (A) forming the dispensing head, part (B) forming the pump body and shutter, part (C) forming the spring, and part (D) forming the piston, retaining ring and plunger tube.

To advantage, part (D) forming the piston, retaining ring and plunger tube also forms the inlet valve seat of the pump chamber, interacting with a valve element.

According to one embodiment variant, the valve element is integral with the part (B) forming the pump body and shutter.

According to another embodiment variant, the valve element is a separate part (E) such as a ball.

To advantage, said pump chamber is placed immediately upstream of said dispensing orifice, said shutter forming an outlet valve of said pump chamber.

The subject matter of the present invention also comprises a device for dispensing fluid products, including a tank and a pump as described above.

To advantage, the pump is anchored, in particular by being snapped onto the tank with the interposition of a gasket.

BRIEF DESCRIPTION OF THE DRAWINGS

Other characteristics and advantages of the present invention will emerge more clearly from the following detailed description of a number of embodiments and variants of the present invention, drawn up with reference to the appended drawings, given as non-restrictive examples and wherein.

DETAILED DESCRIPTION OF EXEMPLARY EMBODIMENTS OF THE INVENTION

Figure 1:
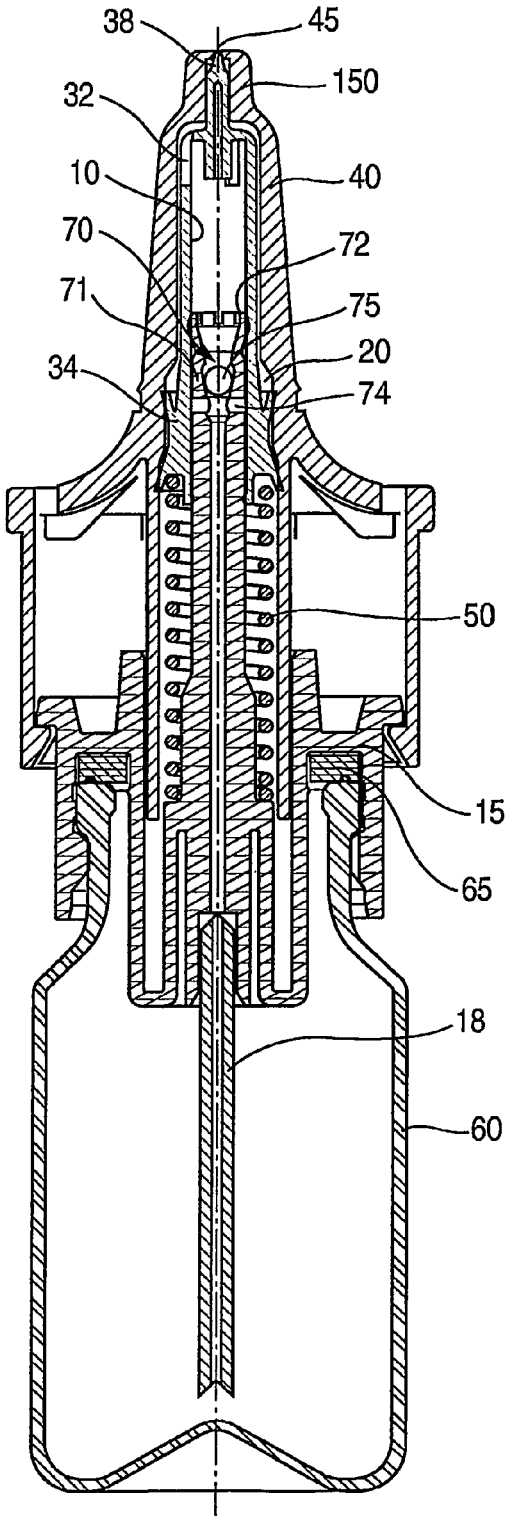
FIG. 1 is a diagrammatic view in transverse cross-section of a device for dispensing fluid products and comprising a pump for dispensing fluid products embodied according to an advantageous embodiment of the present invention, in the rest position of the pump.

The dispensing pump according to the present invention comprises a pump body 10 in which at least one piston 72 slides. Said at least one piston 72 slides in a pump chamber 20 to dispense a dose of fluid product through a dispensing orifice 45, each time the pump is actuated. Said pump chamber 20 preferably comprises an inlet valve 70. To avoid any contamination of the product between two actuations, the dispensing orifice 45 is provided with a shutter or obturator 38 which is movable and/or deformable between a closed position of this dispensing orifice 45 and an open position thereof, said shutter 38 being elastically driven to its closed position. According to the invention, the pump comprises only one elastic element 50, such as a spring, which is adapted both for bringing the piston 72 back to its rest position after actuation and for driving the shutter 38 to its closed position. To advantage, this spring is placed away from any contact with the fluid product, which avoids any danger of contamination, particularly when this spring is made of metal. Preferably, the pump comprises a dispensing head 40 which incorporates the dispensing orifice 45. To advantage, the pump chamber 20 is placed at least partially in said dispensing head 40, directly upstream of said dispensing orifice 45. The shutter 38 then forms the outlet valve of this pump chamber. The pump may be anchored or fixed to a tank 60 containing the fluid product by means of a retaining or fixing ring 15 which may be of any desired type, able for example to be screwed on, snapped on or crimped. Preferably, the pump is assembled on the tank 60 by means of said retaining ring 15 with interposition of a gasket 65 between these two elements.

Figure 2:
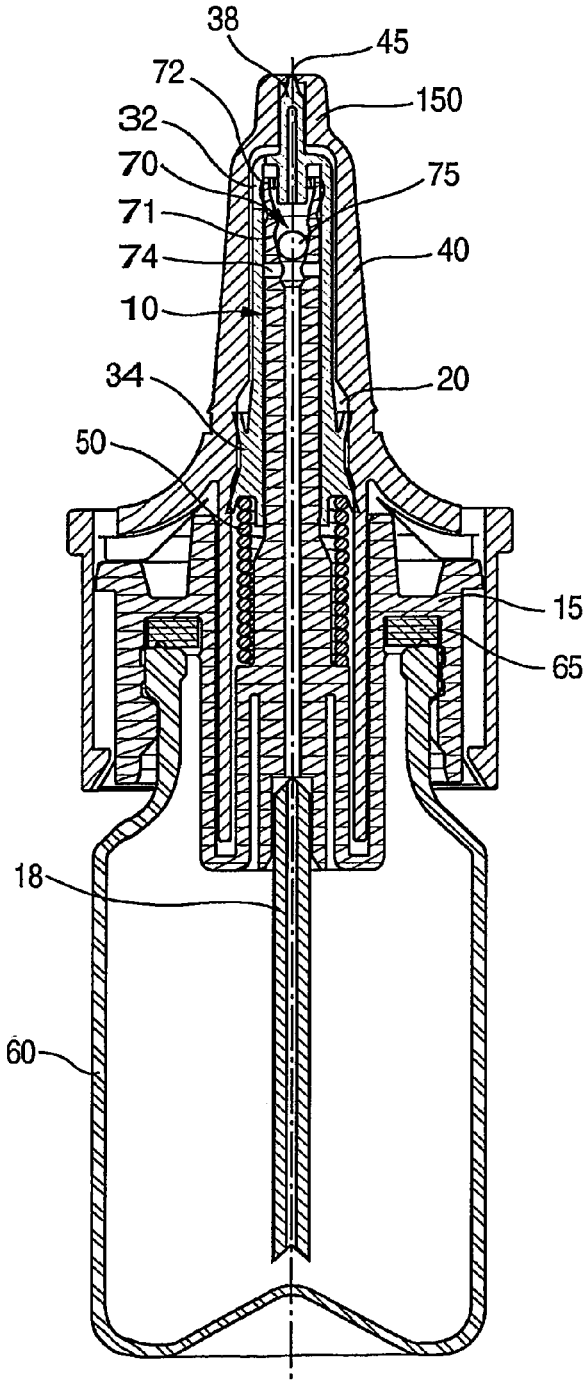
FIG. 2 is a view similar to that in FIG. 1 at the end of pump actuation.

FIGS. 1 and 2 show one advantageous embodiment of the present invention. In this embodiment, the pump body 10 is embodied in one piece with the shutter 38, and the piston 72 therefore slides inside said shutter 38. The pump body 10 is therefore placed inside said head 40. The anchoring element 15 is itself made in one piece with the piston 72 and the seat of the inlet valve 71. The plunger or dip tube 18 is in this example added on, but it could of course also be embodied in one piece with said retaining ring 15. The return spring 50 is directly in contact with a second piston 34 integral with the shutter 38, by being placed around said tubular element forming the piston 72 and the valve seat 71 of the inlet valve 70 of the pump chamber 20. The valve element 75 is in this example embodied in the form of an added element, in particular a ball 75 interacting with said valve seat 71. The part forming the pump body 10 and shutter 38 comprises in this embodiment an opening 32 adapted to interact with the piston 72 to allow priming. In this embodiment example, when the user presses axially on the dispensing head 40, he drives the ball 75 into closure contact with the valve seat 71. Then, with the rise in pressure in the pump chamber 20, the part forming the pump body 10 and shutter 38 is displaced axially inside the head 40 to allow the expulsion of the product dose contained in the pump chamber 20. To advantage, to achieve a good quality spray, the dispensing orifice 45 comprises a spray profile (not shown) which can for example be provided in an axial sleeve 150 of the head 40 in which said shutter 38 slides. This pump is primed through the opening 32 provided in the shutter 38 which interacts with the piston 72. Indeed, when the pump chamber is filled with air, this can be compressed and the piston 72 can slide in the pump body 10 together with the head 40, as far as the position shown in FIG. 2, in which the piston 72 penetrates into said opening 32, without the shutter 38 opening. This creates a passage for the air outside said tubular sleeve forming the valve seat 71 as far as a radial passage 74 provided upstream of the ball 75 of the inlet valve 70. The air is therefore expelled towards the inside of the tank 60 through said radial passage 74 when priming. Then, when the pump chamber fills with fluid product, the piston 72 will no longer reach this end position in which it is interacting with the opening 32, during normal operation of the pump, but only at the end of actuation.

Figure 3:
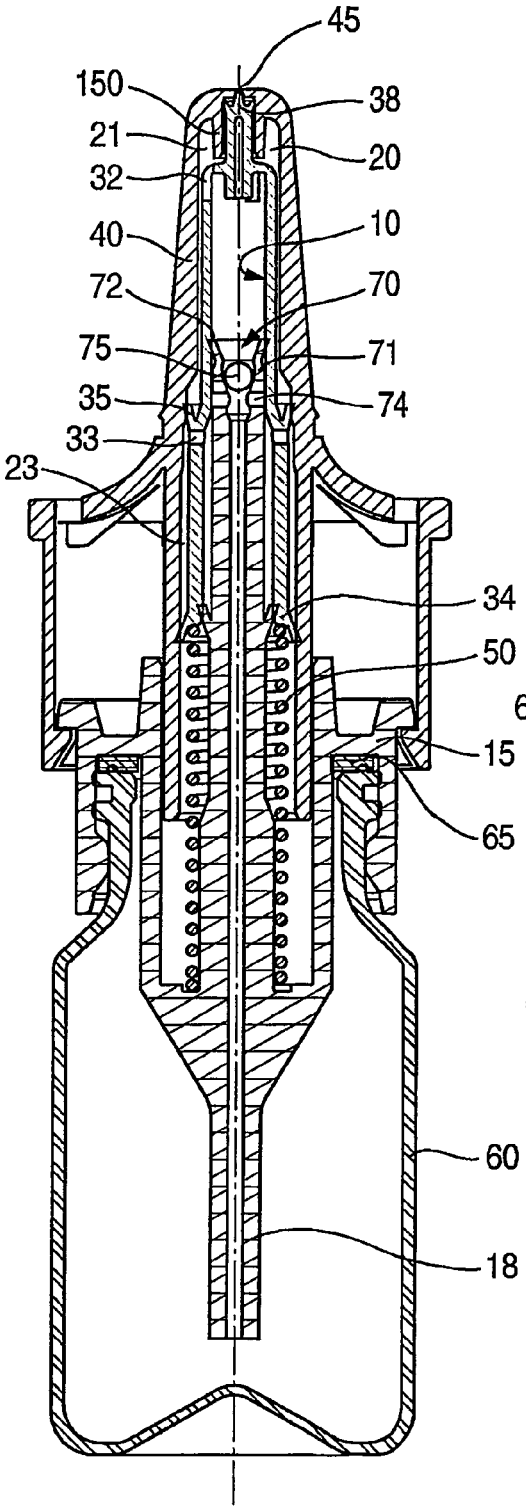
FIG. 3 is a diagrammatic view in transverse cross-section of a device for dispensing fluid products comprising a pump for dispensing fluid products according to another advantageous embodiment of the present invention, in the rest position of the pump.
Figure 4:
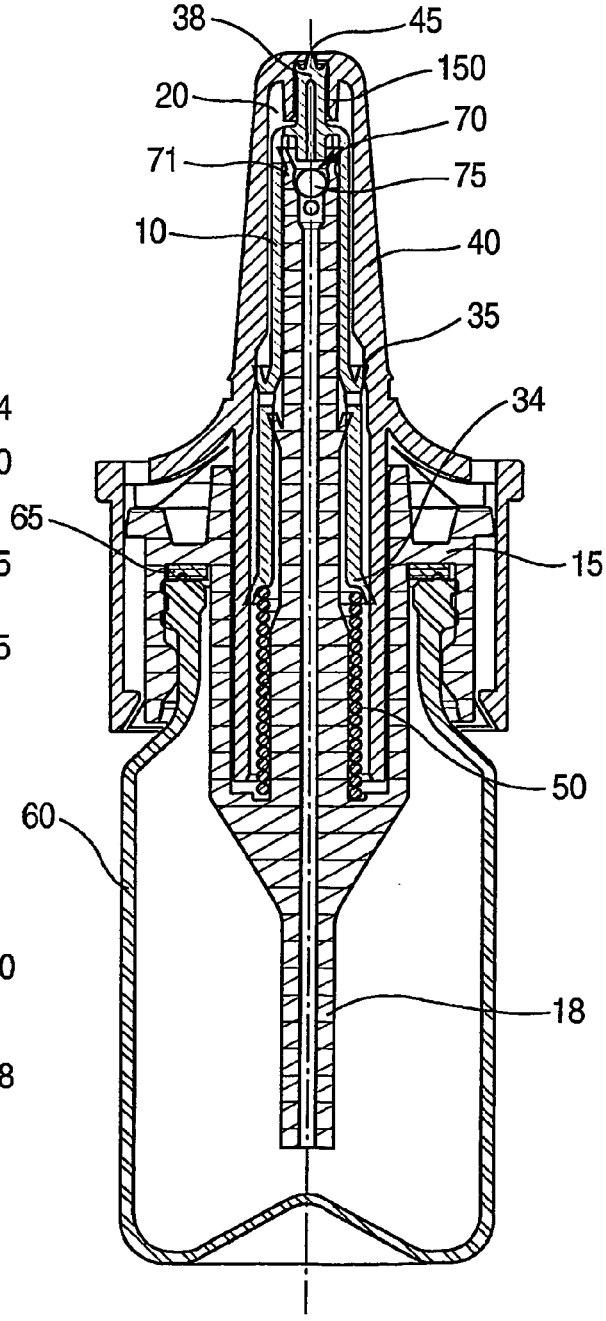
FIG. 4 is a view similar to that in FIG. 3, at the end of pump actuation.

FIGS. 3 and 4 show a further advantageous embodiment of the present invention. This is distinguished from the embodiment shown in FIGS. 1 and 2 in that the plunger tube 18 is embodied in one piece with the anchoring element 15 and in that the part forming the pump body 10 and shutter 38 comprises a third piston 35 also sliding in the head 40 and separating the pump chamber 20 into a first pump chamber part 21, placed directly upstream of the dispensing orifice 45, and a second pump chamber part 23 placed between said second piston 34 and said third piston 35. A passage 33 is provided in this second pump chamber part 23 to allow part of the product contained in the pump chamber 20 to be discharged in certain particular conditions. Indeed, in order to ensure a good quality spray, it is desirable for the shutter 38 not to move by too great a distance relative to the dispensing orifice 45. In fact, when the user actuates the pump abruptly and with some force, there is a risk that the pressure which rises rapidly in the pump chamber may cause too great a displacement of this shutter in the axial sleeve 150 provided in the bottom of the head 40. In this case, the head 40 comprises passage means interacting with the third piston 35 in order, after a preset axial displacement of said shutter 38, to open the connection between the first pump chamber part 21 and the second chamber part 23, thereby causing an overpressure in this second pump chamber part 23, and therefore a discharge of a part of the product through the passage 33 towards the radial passage 74 then the plunger tube 18 in the direction of the tank 60.

The figures show different embodiment variants, but other embodiments are also conceivable. For example, the pump body could be embodied in one piece with the dispensing head, the piston then sliding directly in this head.

Figure 5:
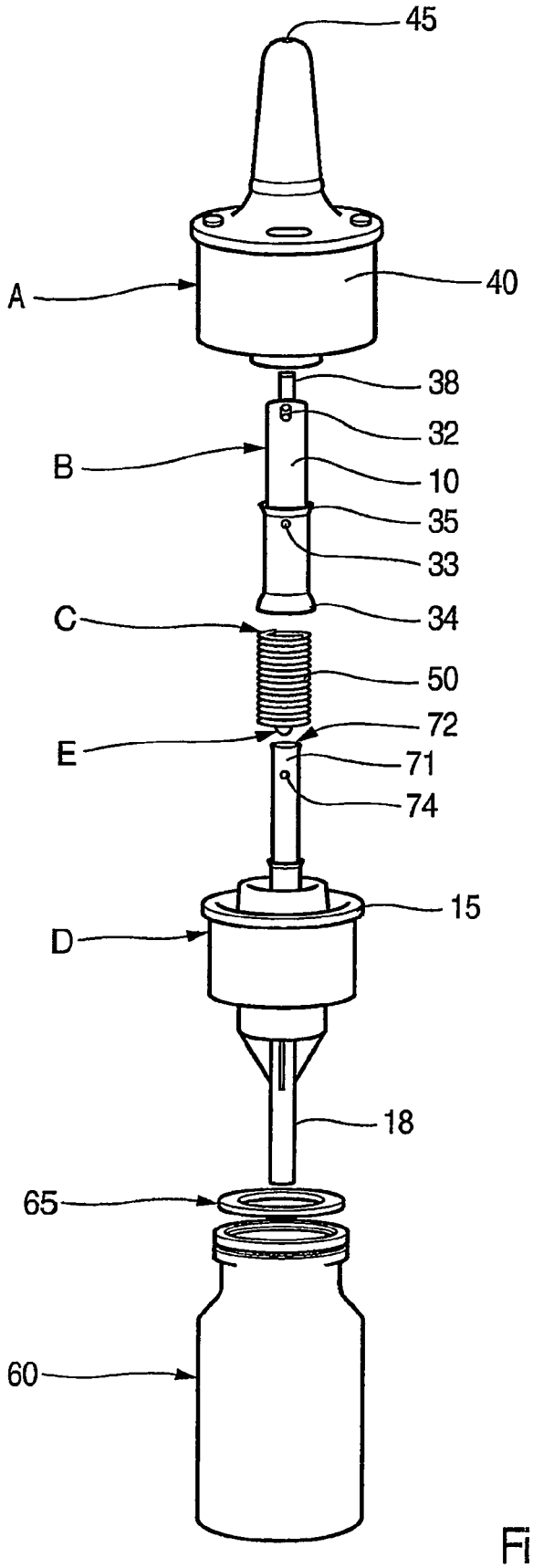
FIG. 5 is an exploded diagrammatic view in perspective of the device for dispensing fluid products shown in FIGS. 3 and 4.

One particular advantage of the present invention is that it makes it possible to implement a pump with a minimum number of constituent parts. Thus, with particular reference to FIG. 5, it can be seen that the pumps in FIGS. 1 to 4 can be made with only four components, namely part A forming the dispensing head 40, part B forming the pump body 10 and shutter 38, part C forming the spring 50, and part D forming the piston 72, retaining ring 15 and plunger tube 18. Possibly, when the valve element 75 of the inlet valve 70 of the pump chamber 20 is embodied in the form of a separate part E (for example a ball), it may be considered that the pump comprises a fifth part. The pump is then assembled on the tank 60 with interposition of a gasket 65, and it can thus clearly be seen that the number of parts in the pump according to the invention is lower compared with prior art pumps, which simplifies the manufacture and assembly of this pump and therefore makes it less expensive. Likewise, the operation of this pump is reliable, guaranteeing a good quality spray, and making priming easier. Likewise, the fact that the return spring is never in contact with the fluid product avoids any risk of the product being corrupted through contact with a metal part (when this spring is made of metal).

Although the invention has been described with reference to various embodiments thereof, it is understood that it is not restricted by the examples shown. On the contrary, a man skilled in the art may make any effective modifications thereto without departing from the context of the present invention as defined in the appended claims.

The invention claimed is:

1. Pump for dispensing fluid products comprising a pump body (10), a pump chamber (20) formed inside said pump body (10), at least one piston (72) sliding in said pump chamber (20) to dispense the fluid product, a dispensing head (40) including a dispensing orifice (45), and a shutter (38) interacting with said dispensing orifice (45), said shutter (38) being movable and/or deformable between a closed position of the dispensing orifice (45) and an open position of the dispensing orifice (45), said shutter (38) being elastically driven to its closed position, wherein the pump comprises only one elastic element (50) adapted for bringing said at least one piston (72) back to its rest position after actuation and for driving said shutter (38) to its closed position, and in that said pump body (10) is embodied in one piece with said shutter (38), and wherein the dispensing orifice (45) is structurally configured to provide a spray such that the dispensing orifice (45) receives the fluid product and converts the fluid product into the spray when dispensing the fluid product.

2. Pump according to claim 1, wherein said elastic element (50) is away from all contact with the fluid product.

3. Pump according to claim 1, wherein the pump comprises a retaining ring (15) adapted to anchor said pump to a tank (60).

4. Pump according to claim 3, wherein said retaining ring (15) is embodied in one piece with a plunger tube (18) intended to extend in a tank (16).

5. Pump according to claim 3, wherein said retaining ring (15) is embodied in one piece with an inlet valve seat (71) of the pump chamber (20).

6. Pump according to claim 3, wherein said piston (72) is embodied in one piece with said retaining ring (15).

7. Pump according to claim 3, wherein said dispensing head (40) is connected, particularly by being snapped, irremovably onto said retaining ring (15), said dispensing head (40) and said retaining ring (15) forming a stop to define the rest position of the pump.

8. Pump according to claim 1, wherein said pump body (10) is placed inside said dispensing head (40).

9. Pump according to claim 1, wherein said pump further comprises a retaining ring (15) and a plunger tube (18), and wherein the dispensing head (40) forms a one piece integral construction, the pump body (10) and the shutter (38) form a one piece integral construction, the elastic element (50) forms a one piece integral construction, and the piston (72), the retaining ring (15) and the plunger tube (18) form a one piece integral construction.

10. Pump according to claim 9, further comprising a seat (71) of an inlet valve (70) of the pump chamber (20) which interacts with a valve element (75), wherein the seat (71) is integrally formed with the piston (72), the retaining ring (15) and the plunger tube (18).

11. Pump according to claim 10, wherein the valve element (75) is separate from the pump body (10).

12. Pump according to claim 10, wherein the valve element (75) is a ball.

13. Pump according to claim 1, wherein said pump chamber (20) is placed immediately upstream of said dispensing orifice (45), said shutter (38) forming an outlet valve of said pump chamber (20).

14. Device for dispensing fluid products including a tank (60), characterized in that the device comprises a pump according to claim 1.

15. Device according to claim 14, wherein the pump is anchored, particularly by being snapped on to the tank (60) with interposition of a gasket (65).

16. Pump according to claim 1, wherein the elastic element (50) is a spring.

17. Pump according to claim 1, wherein the dispensing orifice (45) is disposed at a distal end of the dispensing head (40) such that the fluid product is immediately dispensed from the dispensing head (40) to an outside of the pump after passing through the dispensing orifice (45).

* * * * *